United States Patent [19]

Nordgren

[11] 3,976,012

[45] Aug. 24, 1976

[54] ARRANGEMENT FOR AUTOMATIC SWITCHING IN ELECTRIC FUSES FOR PROJECTILES

[75] Inventor: John Lennart Nordgren, Jarfalla, Sweden

[73] Assignee: U.S. Philips Corporation, New York, N.Y.

[22] Filed: May 21, 1974

[21] Appl. No.: 471,968

[30] Foreign Application Priority Data

May 21, 1973 Sweden ..... 7307112

[52] U.S. Cl. ..... 102/70.2 R; 89/6

[51] Int. Cl.[2] ..... F42C 11/00; F42C 17/00

[58] Field of Search ..... 102/70.2 R, 70.2 P, 102/74; 89/6

[56] References Cited

UNITED STATES PATENTS

| | | | |
|---|---|---|---|
| 1,791,606 | 2/1931 | Rühlemann | 102/70.2 R |
| 1,794,421 | 3/1931 | Rühlemann | 102/70.2 R |
| 1,841,983 | 1/1932 | Rühlemann | 102/70.2 R |
| 2,998,773 | 9/1961 | Rühlemann | 102/74 |
| 3,362,331 | 1/1968 | Lagerström | 102/70.2 P |
| 3,722,416 | 3/1973 | Lünt et al | 102/70.2 P |

*Primary Examiner*—Charles T. Jordan
*Attorney, Agent, or Firm*—Frank R. Trifari; Bernard Franzblau

[57] ABSTRACT

An automatic switching arrangement in electric fuses for projectiles which can be set on at least three different operational functions, for example proximity fuse function and inpact fuse function with two different sensitivities. The electric fuse comprises at least two separate ignition circuits each having an inhibition control terminal connected to the respective ignition circuit so that this circuit functions normally when the associated control terminal is connected to ground and is deactivated when the ground connection is interrupted. The inhibition control terminals are connected to ground through individual fusible wires. Each fusible wire is connected to an electric contact which is accessible from the outside of the projectile through individual different polarity dependent or amplitude dependent impedance elements. To set the electric fuse on a desired function, the projectiles are moved successively past a setting station comprising a voltage generator. The generator has an output terminal adapted to successively contact said contacts on the projectiles as they move past the generator. Depending on its setting, the generator delivers voltage pulses of different polarity or amplitude whereby selective melting of the fusible wires can be effected by means of the voltage generator for setting the electric fuse.

11 Claims, 4 Drawing Figures

ARRANGEMENT FOR AUTOMATIC SWITCHING IN ELECTRIC FUSES FOR PROJECTILES

Figure 1:
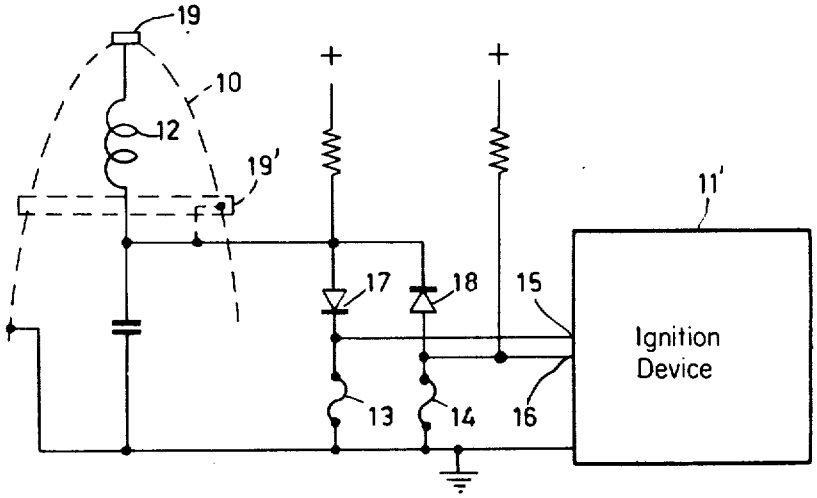

The invention relates to an arrangement in an electric ignition device for projectiles comprising a number of ignition circuits influencing one or more electric igniters for initiating a burst of the projectile according to different functions. In particular it relates to a device which enables automatic switching between at least three different functions, for example proximity fuse function, i.e. a burst at a certain distance from a target, an impact fuse function with instantaneous effect or delayed effect, and possibly further functions.

The advantage of providing such a switching ability is that it will not be necessary to have projectiles with different types of ignition device in store or at the ordnance piece. Previously it has been proposed to use a mechanical switching device which makes it possible to achieve a large number of setting positions corresponding to an equal number of functions in the ignition device. This requires that a manual operation be made on each individual projectile for setting the ignition device on the required function. This means that the switching must be effected before the projectile is fired, which is possible if the type of target to be attacked is known beforehand.

In the process of firing at a target which requires a certain function of the electric ignition device, it may, however, happen that another target suddenly appears, which target requires another function and which target has a higher priority as a hostile object. It is then possible to have the projectiles divided in different compartments with one and the same setting of the ignition device in each compartment, switching from one function to another function being effected by feeding out the projectiles from different compartments. This, however, has on the one hand the drawback that it takes a certain time before fire can start when switching from one function to another function and on the other hand it involves an appreciable complication in the store handling and the feeding mechanisms in automatic weapons, which normally only have one or in special cases two projectile stores.

An object of the invention is to provide automatic and rapid switching between at least three functions of the ignition device without any change being made in the continuous supply of projectiles and even without any interruption in the fire.

According to the invention this is achieved in that the device comprises at least two fusible wires each associated with one of the said ignition circuits and connected to the ignition circuit in such manner that if a fusible wire is intact the associated ignition circuit is effective, while if the fusible wire is melted the ignition circuit is inactivated. The fusible wires are connected to a common contact means which is accessible from the outside of the projectile via polarity dependent or voltage dependent impedance elements. A switchable voltage generating device is provided past which the projectiles are fed at the introduction into the fire tube so that an output contact on the voltage generator will come in contact with the said contact means on the projectile. The voltage generator, depending upon its setting, delivers voltage pulses of different polarity or amplitude whereby, as a result of the setting of the voltage generating device, selective melting of the fusible wires can be produced for setting the fuse on the required function.

In a preferred embodiment of the device according to the invention, two fusible wires are arranged each having a diode in series therewith, which diodes are connected with opposite polarities in the two circuits. This enables setting of the ignition device on four different conditions, namely one condition with both the fusible wires intact, two conditions with the one or the other fusible wire melted and a fourth condition with both wires melted. The advantage of using polarity sensitive impedance elements is that it is possible to select relatively high amplitudes of the voltage pulses for melting the wires, whereby the device will be reliable and insensitive to varying parameters, such as different contact resistances and the like.

If more functions are required than those which can be achieved by means of two fusible wires, a number of fusible wires can be arranged, each in series with a zener-diode, which zener-diodes have different break-down voltages. The voltage generating device is then adapted to generate voltage pulses of different amplitude, which amplitudes are selected such that they will be situated between the break-down voltages for two zener-diodes, whereby all fusible wires, the associated zener-diode of which has a lower break-down voltage than the amplitude of the applied voltage pulse will be melted, while the remaining wires will be intact.

Figure 2:
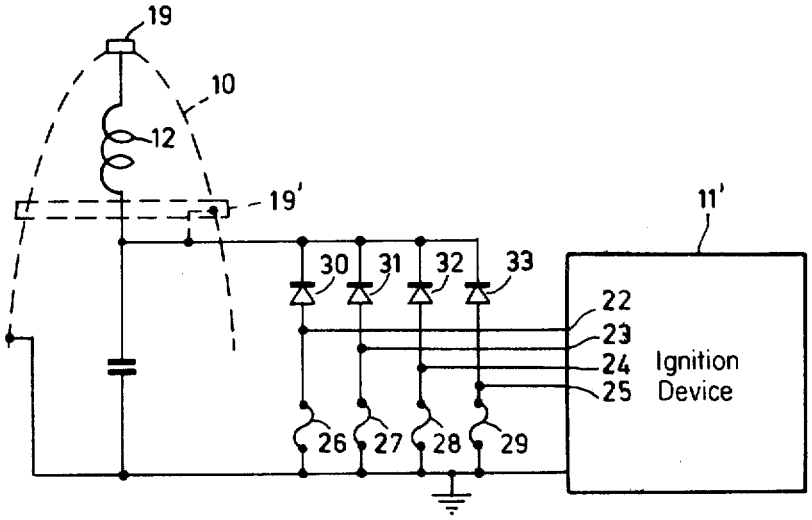
Figure 3:
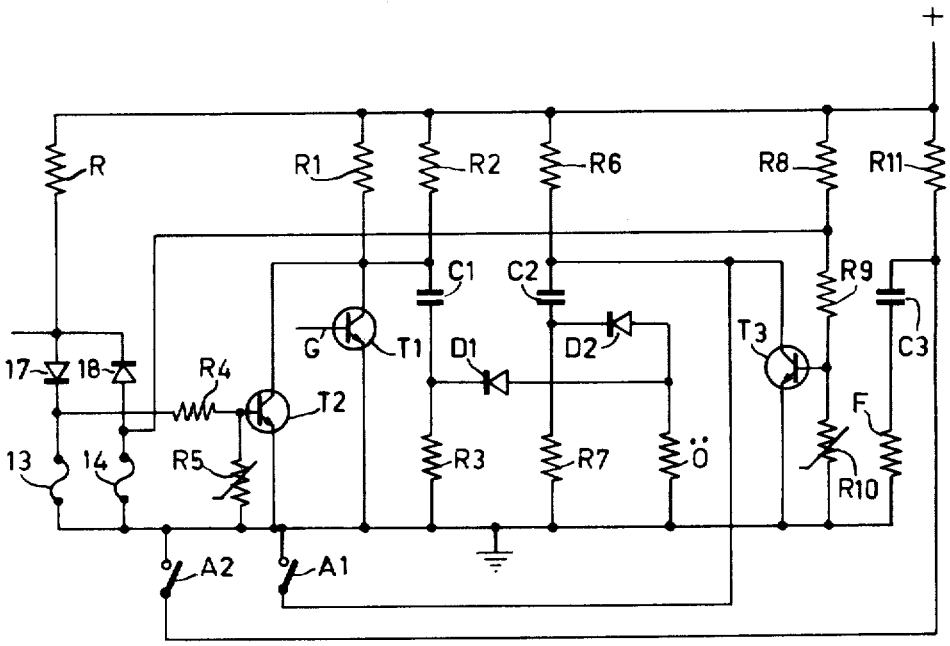
Figure 4:
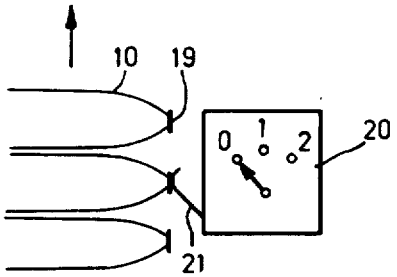

The invention is illustrated in the accompanying drawing, in which:

FIG. 1 shows a schematic view of a device according to the invention comprising two fusible wires each in series with a diode, and an ignition device which is only schematically indicated by a block, FIG. 2 shows an alternative embodiment comprising a number of fusible wires each in series with a zener-diode, FIG. 3 shows a detailed circuit diagram for a device according to the said first alternative, in which switching is effected between a proximity fuse function and an impact fuse function with immediate and delayed effect, and FIG. 4 shows a simplified view of a station for automatic setting of the function of the fuse by selective melting of the fusible wires.

In FIG. 1 reference numeral 10 designates the envelope of an electric ignition device, which envelope is screwed to the nose of a projectile to be ignited by means of the ignition device. The ignition device itself is schematicaly indicated by the block 11' and consists of two main parts, a proximity fuse part and an impact fuse part, the said impact fuse part also comprising an impact fuse function with delayed effect. The proximity fuse part is assumed to be of the electromagnetic type and transmits a continuous electromagnetic wave. By combination of electromagnetic energy reflected against targets in the vicinity of the projectile a doppler signal is generated, which is led to an ignition circuit comprising an electric igniter which initiates a burst upon receipt of a given energy value of the doppler signal. The proximity fuse part comprises for this purpose an oscillator which is coupled to an antenna coil 12 serving both as a transmitting and receiving antenna. The impart fuse part comprises at least one impact contact included in a separate ignition circuit with an electric igniter, which either can be a separate igniter or the same igniter as that initiated by means of the doppler signal. Furthermore there is a further ignition circuit which is actuated by the impact contact or a separate impact contact, which circuit produces a delayed effect upon impact. The delayed burst can suitably be achieved by means of a special electric igniter having an inherent delay.

According to the invention two fusible wires 13, 14 are connected between two control inputs 15, 16 of the ignition device 11' and ground. The control input 15 leads to a control element included in the proximity fuse part. The coupling is such that when the control input 15 is connected to ground through the fusible wire 13, the said fuse part has its normal function. However, when the control input loses its ground connection for positive voltage the fuse part is inactivated. The other control input 16 leads to a control element which influences the ignition circuit included in the impact fuse part, which initiates an immediate burst upon impact. In the same manner as in the proximity fuse part the said ignition circuit for immediate burst has its normal function when its control input 16 has ground connection through the fusible wire, while the circuit is inactivated when the ground connection to 16 is interrupted.

The third ignition circuit for initiating a burst with delayed effect is continuously active.

The non-grounded ends of the fusible wires 13, 14 are each connected via a diode 17, 18 and, in the shown example, via the antenna coil 12, to a common nose contact 19. The nose contact is mounted in a part of the envelope 10 which is made of insulating material. The remaining part of the envelope of the ignition device as well as the envelope of the projectile itself is made of metal. The electric ground in the ignition device is connected to the said last part made of metal. Instead of using a nose contact 19, a contact ring 19' also can be arranged as the outer contact element, as indicated in the drawing by dotted lines.

By applying voltages of different polarity between the nose contact 19 or the contact ring 19', respectively, and ground selective melting of the fusible wires can be effected for the purpose of producing function switching of the ignition device. Thus the fusible wire 13 will be melted if a positive voltage is applied to the nose contact in relation to ground. If a negative voltage is applied instead the wire 14 will be melted. If both positive and negative voltages are applied both wires will melt.

The function switching can suitably be effected automatically, as indicated schematically in FIG. 4. The individual projectiles are, according to FIG. 4, immediately before their introduction into the fire tube, transported past a voltage generating device 20, from which a resilient contact 21 projects. The projecting contact 21 touches the nose contact on each projectile which is transported past the device. For each new projectile, which is in position opposite the voltage generator, this generator delivers an output pulse (possibly absence of a pulse) which depends upon the setting of the generator. In the present example the generator has three different setting positions, designated 0, 1 and 2. In the position 0 the generator does not deliver any voltage pulse. Both fusible wires in the ignition device will remain intact. In the position 1 a positive voltage pulse is generated. This pulse is passed via the diode 17 and will melt the fuse wire 13. In the position 2 both a positive pulse and a negative pulse are generated in rapid succession. As a result both the fusible wire 13 and the wire 14 are melted.

In the position 0 of the voltage generating device both fusible wires remain intact. This means that both the proximity fuse part in the ignition device and the impact fuse part are active. The ignition device then acts as a proximity fuse with the impact fuse function as a reserve function. In the position 1, when only the wire 13 is melted, the proximity fuse part is inactivated. The impact fuse part is, however, fully active and the ignition device acts as an impact fuse with immediate impact fuse function. In the position 2, when both wires are melted, both the proximity fuse part and the impact ignition circuit for immediate burst are deactivated. The ignition device then acts as an impact fuse with delayed effect. The further possibility, which has not been utilized in the present example, namely if the fusible wire 14 has been melted but not the fusible wire 13, is that the proximity fuse part is active together with the impact ignition circuit with delayed effect, which function, however, normally is of no interest.

FIG. 2 shows an alternative embodiment of the device according to the invention, in which figure corresponding components have been provided with the same reference numerals as in FIG. 1. The ignition device 11' is in this example assumed to be extended to include further functions, on which it can be set, for example, besides the previously mentioned functions, different sensitivity of the proximity fuse part and different sensitivity of the impact fuse part. The ignition circuits producing the different functions can be inactivated by interrupting the ground connection to the four control inputs 22–25. The control inputs are, according to the invention, each connected to ground via a fusible wire 26–29. The non-grounded terminals of the fusible wires are connected to the common nose contact 19 via the antenna coil 12 or the contact ring 19', respectively, and individual zener-diodes 30–33. The zener-diodes have different break-down voltages with successively increasing value of the said voltage as counted from the left to the right in the drawing. The break-down voltage can, for example, be 5, 10, 15 and 20 volt, respectively.

Function switching is in this example effected by applying a positive voltage with different amplitudes between the contact 19 or 19' and ground. The voltage generating device 20 according to FIG. 4 has in this example five setting positions. In the first position no voltage pulse is produced and all fusible wires will remain intact. in the second position a positive voltage pulse with an amplitude amounting approximately to a value lying half way between the break-down voltages for the zener-diodes 30 and 31 is generated. The wire fuse 26 will then be melted, while the remaining wires remain intact. In the next setting position of the device 20 it generates a positive voltage pulse having an amplitude amounting approximately to a value lying halfway between the break-down voltages for the zener-diodes 31 and 32. The wires 26 and 27 will be melted, while the remaining wires remain intact. In the same manner the wires 26, 27 and 28 are melted in the fourth setting position of the device 20 and in the last setting position all wires are melted. Each such condition of the ignition device 11' corresponds to a certain given function. Generally the ignition device can be set on a number of functions which is equal to the number of fusible wires or zener-diodes plus 1.

FIG. 3 shows a detailed circuit diagram for an embodiment according to the alternative as shown generally in FIG. 1. The ignition circuit for the proximity fuse part consists, according to FIG. 3, of a series circuit comprising a thyristor $T_1$, to which is applied a positive voltage via a resistance $R_1$, a capacitor $C_1$, a diode $D_1$ and an electric igniter Ö. The capacitor $C_1$ is kept charged through resistances $R_2$, $R_3$. The doppler signal derived from the oscillator is fed to the control electrode G of the thyristor and will ignite the thyristor at a certain amplitude of the doppler signal. Furthermore a signal is applied to G from an auto-destruction device. When the thyristor is ignited the capacitor $C_1$ will be discharged through the igniter Ö which then initiates a burst.

In parallel with the capacitor $C_1$ a transistor $T_2$ is connected to ground. The base of the transistor $T_2$ receives ground potential through the fusible wire 13. By means of the ground connection $T_2$ is kept in a cut-off condition. When the ground connection is interrupted by melting the wire 13, the base of the transistor $T_2$ will receive a positive voltage through a resistance R and will become fully conducting. The capacitor $C_1$ cannot then be charged and the ignition circuit of the proximity fuse part is inactivated. R can be the oscillator in the proximity fuse part. $R_4$ and $R_5$ are resistances ($R_5$ being voltage dependent) which protect the transistor $T_2$ during the transition to the conducting condition.

The ignition circuit for instantaneous burst upon impact consists of a series circuit comprising an impact contact $A_1$, a capacitor $C_2$, a diode $D_2$ and the electric ignitor Ö. The capacitor $C_2$ is kept continuously charged through resistances $R_6$, $R_7$. Upon impact the said series circuit is closed via the impact contact $A_1$. The capacitor $C_2$ will be discharged through the electric ignitor O and initiates a burst.

In parallel with the capacitor $C_2$ a transistor $T_3$ is connected to ground. The base of transistor $T_3$ has ground connection through the fusible wire 14 (and wire 13 in series with the diodes 17, 18). By means of the ground connection the transistor $T_3$ is kept in a cut-off condition. When the ground connection is inerrupted by melting the fusible wire 14 together with the wire 13, the base of the transistor $T_3$ will receive a positive voltage via resistances $R_8$, $R_9$ and will become fully conducting, whereby the capacitor $C_2$ cannot be charged. The ignition circuit for instantaneous burst upon impact is thereby inactivated. A voltage dependent resistance $R_{10}$ protects the transistor $T_3$ during the switching operation.

Should the fusible wire 14 be melted but not the wire 13, the base of the transistor $T_3$ will still have a ground connection through fuse 13 but in series with the two diodes 17 and 18. The positive voltage drop across the two series connected diodes 17, 18 will then be sufficient to make the transistor $T_3$ fully conducting, whereby the capacitor $C_2$ also cannot be charged in this case and the ignition circuit for instantaneous burst is inactivated.

The ignition circuit for delayed burst upon impact consists of a series circuit comprising an impact contact $A_2$, a capacitor $C_3$ and an electric igniter F. The capacitor $C_3$ is charged through a resistance $R_{11}$ and the electric igniter F. Upon impact the contact $A_2$ will be closed whereby the said series circuit will be closed and the capacitor $C_3$ will be discharged through the igniter F. This electric igniter has an inherent delay so that a burst will only be initiated after a certain time interval from the closure of contact $A_2$.

What is claimed is:

1. In an electric ignition device for a projectile including a number of ignition circuits controlling electric igniters for initiating at least three different functions including a proximity fuse function, an impact fuse function with instantaneous effect, and an impact fuse function with delayed effect, the improvement comprising, a common contact means accessible from the outside of the projectile to receive an external function select voltage, first and second unidirectional current conducting impedance elements, first and second fusible wires, means connecting the first unidirectional impedance element in series circuit with the first fusible wire to said common contact means, means connecting the second unidirectional impedance element in a second series circuit with the second fusible wire to said common contact means, means coupling the two fusible wires to respective ones of the said ignition circuits so that if a fusible wire is intact the associated ignition circuit is active and if the fusible wire is melted the ignition circuit is inactivated, a switchable voltage generating device past which the projectiles are transported so that an output contact on the voltage generator contacts said common contact means on the projectile to apply thereto said function select voltage whereby in dependence upon a switch setting of the voltage generating device selective melting of the fusible wires can be achieved for setting the ignition device to a desired function.

2. A device as claimed in claim 1 wherein said unidirectional impedance elements comprise first and second diodes connected with opposite polarity to the common contact means, the voltage generating device being adapted to deliver positive and negative voltage pulses to its output contact.

3. A device as claimed in claim 1, wherein said unidirectional impedance elements comprise a plurality of zener-diodes with successively increasing breakdown voltages, the voltage generating device being adapted to generate voltage pulses of the same polarity but different amplitudes for selectively melting those fusible wires of the associated series zener-diodes which have a lower break-down voltage than the applied voltage pulse.

4. An automatic function select apparatus for setting an electric ignition device in a projectile to predetermined ones of a plurality of functional operation modes comprising, a contact electrode accessible from the outside of the projectile for receiving an external function select voltage, first and second fuses, first and second diodes, means connecting the first diode in series circuit with the first fuse between said contact electrode and a point of reference potential, means connecting the second diode in a second series circuit with the second fuse between said contact electrode and said point of reference potential, and means individually coupling said first and second fuses to first and second input terminals of the electric ignition device so that selective melting of said fuses in response to receipt of the function select voltage at the contact electrode operates to control the electric ignition device to select a desired operation mode.

5. Apparatus as claimed in claim 4 wherein said first and second diodes are connected with opposite polarity to the contact electrode.

6. Apparatus as claimed in claim 5 further comprising an external voltage generator having means for selectively applying positive and negative function select voltages to said contact electrode.

7. Apparatus as claimed in claim 5 wherein said electric ignition device comprises, first and second ignition circuits each having an inhibit control terminal connected respectively to said first and second input terminals, said first ignition circuit further comprising a third input terminal for receipt of a proximity control signal, and means for applying a proximity control signal to said third input terminal independently of said first and second fuses.

8. Apparatus as claimed in claim 7 wherein said first ignition circuit comprises, in series circuit, a capacitor, a third diode, an electric igniter and a first controlled switching device having a control electrode coupled to said third input terminal, and a second controlled switching device connected across the capacitor and with its control electrode constituting said inhibit control terminal, and a charge circuit coupled to said capacitor.

9. Apparatus as claimed in claim 4 wherein said first and second diodes comprise first and second zener diodes having different voltage breakdown levels.

10. Apparatus as claimed in claim 9 further comprising a separate voltage generator having means for selectively applying to said contact electrode first and second voltages of the same polarity but different voltage levels related to the breakdown voltage levels of said first and second zener diodes, respectively.

11. Apparatus as claimed in claim 9 further comprising a third fuse and a third zener diode connected in a third series circuit between said contact electrode and said point of reference potential, and means individually coupling the third fuse to a third input terminal of the electric ignition device to provide selective melting of the fuse in response to a given function select voltage at the contact electrode.

* * * * *